US010653178B1

(12) United States Patent
Kerr et al.

(10) Patent No.: US 10,653,178 B1
(45) Date of Patent: May 19, 2020

(54) METHOD AND APPARATUS FOR AN AEROSOL GENERATION DEVICE

(71) Applicant: Realizer Technologies, LLC, Cheyenne, WY (US)

(72) Inventors: Ian Ashley Kerr, Scottsdale, AZ (US); Love Muhyi Sobhani, Scottsdale, AZ (US)

(73) Assignee: Realizer Technologies, LLC, Cheyenne, WY (US)

( * ) Notice: Subject to any disclaimer, the term of this patent is extended or adjusted under 35 U.S.C. 154(b) by 0 days.

(21) Appl. No.: 16/388,332

(22) Filed: Apr. 18, 2019

(51) Int. Cl.

| | |
|---|---|
| ***A24F 47/00*** | (2020.01) |
| ***A24B 15/167*** | (2020.01) |
| ***B05B 17/00*** | (2006.01) |
| ***B05B 17/06*** | (2006.01) |

(52) U.S. Cl.
CPC ..... *A24F 47/002* (2013.01); *A24B 15/167* (2016.11); *B05B 17/06* (2013.01); *B05B 17/0607* (2013.01); *B05B 17/0646* (2013.01)

(58) Field of Classification Search
CPC . A24F 47/002; A24B 15/167; B05B 17/0646; B05B 17/06; B05B 17/0607
USPC ..... 239/4, 102.1, 102.2, 332, 338; 128/200.14, 200.16; 131/275, 329
See application file for complete search history.

(56) References Cited

U.S. PATENT DOCUMENTS

| | | | | |
|---|---|---|---|---|
| 6,539,937 | B1 | 4/2003 | Haveri | |
| 6,978,779 | B2 | 12/2005 | Haveri | |
| 8,127,772 | B2 | 3/2012 | Montaser | |
| 8,671,934 | B2 | 3/2014 | Addington et al. | |
| 9,022,027 | B2 | 5/2015 | Addington et al. | |
| 2008/0006264 | A1 | 1/2008 | Gallem et al. | |
| 2008/0217430 | A1* | 9/2008 | Feriani | B05B 17/0646 239/102.2 |
| 2008/0315005 | A1* | 12/2008 | Michaels | A01M 1/2033 239/4 |
| 2009/0095821 | A1* | 4/2009 | Feriani | B06B 1/0238 239/102.2 |
| 2009/0212133 | A1 | 8/2009 | Collins, Jr. | |
| 2016/0271343 | A1 | 9/2016 | Abate et al. | |
| 2016/0325055 | A1 | 11/2016 | Cameron | |

FOREIGN PATENT DOCUMENTS

| | | | |
|---|---|---|---|
| CN | 203899831 | U | 10/2014 |

* cited by examiner

*Primary Examiner* — Steven J Ganey
(74) *Attorney, Agent, or Firm* — Michael T. Wallace

(57) ABSTRACT

An aerosol generation device includes an ergonomically correct unibody within which an aerosol generation device is enclosed. The unibody integrates components of the aerosol generation device into a sleek form factor designed for portability, whereby each component blends into the aesthetics defined by the unibody while providing reusable functionality. Airflow detection is used to activate aerosol generation and spacial orientation detection is used to activate status updates such as battery charge level and solution fill level. A user may define a rate of atomized solution that may be produced by the aerosol generation device through external control of the frequency of operation of the aerosol generation device. Use of medical-grade stainless steel and other hygienically correct components contribute to reusability and, therefore, the reduction of non-biodegradeable waste.

11 Claims, 8 Drawing Sheets

800

METHOD AND APPARATUS FOR AN AEROSOL GENERATION DEVICE

FIELD OF THE INVENTION

The present invention generally relates to aerosol generation devices, and more particularly to electronic aerosol generation devices.

BACKGROUND

Aerosol generators have been utilized to atomize liquid solutions for ingestion into the human blood stream via the bronchial system. In particular, such liquid solutions may be formulated to contain a dissolved or suspended particulate that may be atomized into a fine mist for distribution to the respiratory organs of the body and to the other organs of the body via the interelated circulatory system.

One conventional technique that has been used to atomize a liquid solution includes the use of compressed air that may be circulated through the liquid solution at high velocity to generate an aerosol that may then be inhaled by a person. This so-called jet nebulizer, however, is not considered to be particularly portable due to the size and weight constraints of the concomitant compressor. Accordingly, jet nebulizers are traditionally employed by the user for stationary applications, such as treatments for asthma or other respiratory ailments at home.

Other more portable atomization devices include the use of ultrasonic wave technologies. Such devices, however, are considerably inefficient and produce unintended heating of the liquid to be atomized. Accordingly, such portable atomization devices are overly wasteful and potentially harmful.

Still other conventional atomization devices utilize heating elements for aerosol generation. Electronic cigarettes, so called e-Cigarettes for example, are battery operated and utilize a heating element to atomize a liquid that may contain varying amounts of nicotine, flavorings and/or other chemicals. Such heated atomization elements, however, generate aerosols much less efficiently than their counterpart technologies and further tend to create a residue throughout the inner-workings of the e-Cigarette.

Further disadvantages in common with most conventional atomization devices intended for portability include their manufacture as completely disposable devices and/or disposable sub-components (e.g., batteries, liquid storage tanks, cartridges and atomizing heads). Accordingly, their production and use contribute to the ever-growing, non-biodegradeable waste accumulation resulting in deleterious affects on marine life—not to mention the deleterious affects on the planet's landfills, forests, parks and fields.

Efforts continue, therefore, to develop simplified, reusable and planet-friendly aerosol generation devices that may be used safely and efficiently while remaining portable, ergonomically correct and aesthetically pleasing.

SUMMARY

To overcome limitations in the prior art, and to overcome other limitations that will become apparent upon reading and understanding the present specification, various embodiments of the present invention disclose methods and apparatus for simplified, reusable and planet-friendly aerosol generation devices that may be used safely and efficiently. Atomization devices in accordance with the present invention may be made to be ergonomically correct for the user while increasing adaptability to the user's needs. Portability may be enhanced via a sleek form factor to facilitate stealthy stowage of the atomization device on the user's person for quick and easy retrieval when necessary.

In accordance with one embodiment of the invention, an aerosol generation device comprises a processor, an airway egress port, a user input device coupled to the processor, a generator configured by the processor to generate a signal having a frequency selected in response to a control signal from the user input device, and an atomizer in direct contact with a solution, the atomizer configured to provide atomized solution to the airway egress port at a rate proportional to the selected frequency.

In accordance with an alternate embodiment of the invention, an aerosol generation device comprises a processor including a memory, an airway egress port, a generator configured by the processor to generate a signal having a frequency, an atomizer in direct contact with a solution, the atomizer configured to provide atomized solution to the airway egress port at a rate proportional to the frequency. The processor selects the frequency to be equal to one of a plurality of resonance frequencies associated with the atomizer.

In accordance with an alternate embodiment of the invention, a method of using an aerosol generation device comprises storing a solution in direct contact with an atomizer, vibrating the atomizer at a frequency substantially equal to a resonance frequency of the atomizer and selecting the frequency of vibration in response to a desired rate of atomization. The vibration frequency is selected by a user of the aerosol generation device.

BRIEF DESCRIPTION OF THE DRAWINGS

Various aspects and advantages of the invention will become apparent upon review of the following detailed description and upon reference to the drawings in which.

DETAILED DESCRIPTION

Figure 1:
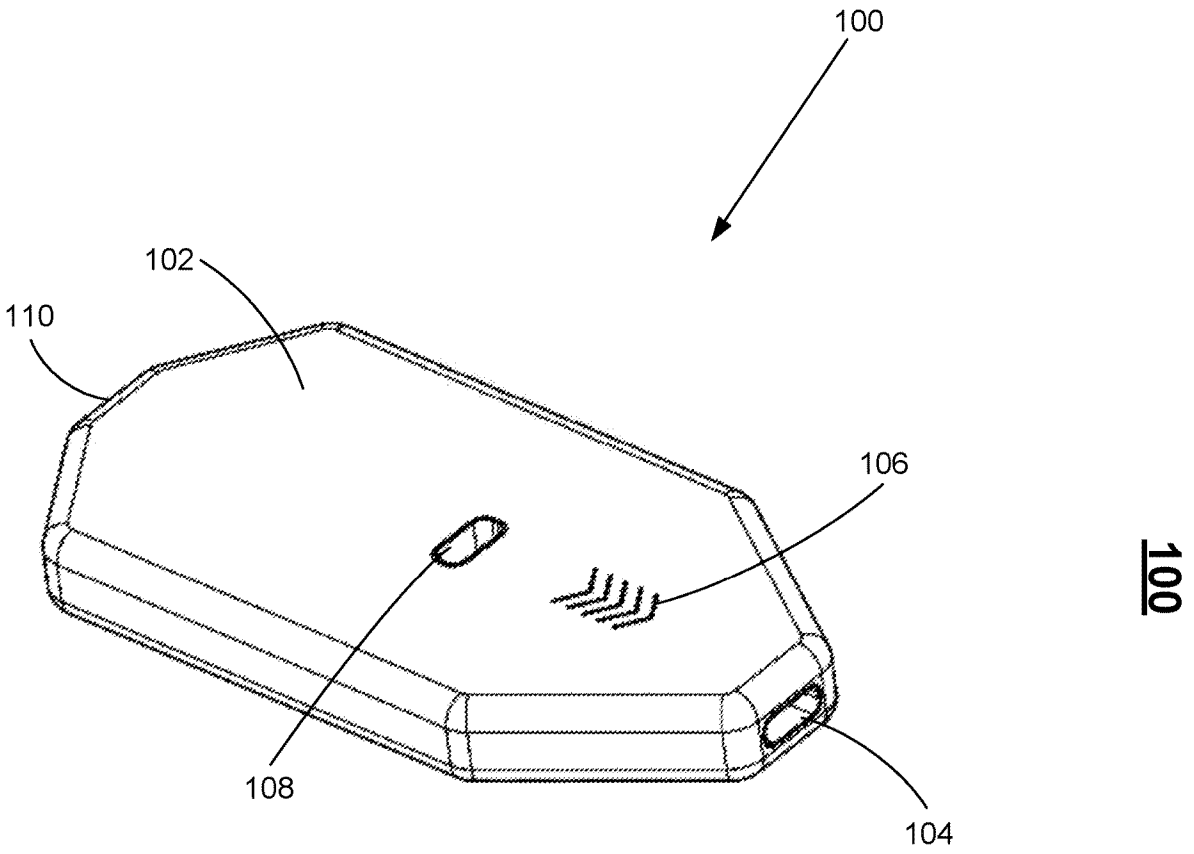
FIG. 1 illustrates a top perspective view of an aerosol generation device in accordance with an embodiment of the present invention.

Generally, the various embodiments of the present invention are applied to an aerosol generation device that may be used to atomize a liquid (e.g., water) that may be infused with virtually any chemical composition (e.g., a cannabinoid (CBD) compound or a tetrahydrocannabinol (THC) compound). The atomized solution may include droplets that may be accurately sized by the aerosol generation device for efficient deposition within the user's bronchial system (e.g., at prescribed sites within the human lung).

In one embodiment, the aerosol generation device may deliver a substantially fixed rate of delivery of atomized solution such that the duration of the inhalation period may determine a volume of atomized solution that may be ingested by the user. In an alternate embodiment, the aerosol generation device may deliver a user-selectable, variable rate of delivery of atomized solution such that the user may select a volume of atomized solution that is to be ingested by the user for any given inhalation period.

A size of atomized droplets produced by the aerosol generation device may be determined by one or more attributes of the atomizing element (e.g., mesh) of the aerosol generation device. In one embodiment, for example, the mesh may be configured with a number of apertures that may exhibit a geometric shape (e.g., circular) and a geometric dimension (e.g., diameter) that may substantially define the size of atomized droplets produced by the mesh. As per one example, the diameter of each droplet produced by the aperture may be proportional (e.g., substantially equal) to the diameter of the aperture.

Further, the mesh may exhibit another geometric dimension (e.g., depth) such that the depth may define a thickness of the mesh, whereby each aperture may exhibit a substantially constant shape (e.g., circular) having a substantially constant dimension (e.g., diameter) throughout the thickness of the mesh, such that each aperture may exhibit a geometric shape (e.g., a cylindrical shape). In alternate embodiments, each aperture may exhibit a substantially constant shape (e.g., circular), but may also exhibit a varying dimension (e.g., a decreasing diameter) throughout the thickness of the mesh, such that each aperture may exhibit a geometric shape (e.g., conical) having a larger diameter on one side of the mesh relative to a smaller diameter on the opposite side of the mesh. Other geometric shapes may also be formed by each aperture, such as square, rectangular, trapezoidal, etc.

The aerosol generation device may be arranged such that the atomizing element (e.g., mesh) may be placed into direct contact with the solution to be atomized. In one embodiment, for example, the mesh may be comprised of medical-grade stainless steel such that corrosion of the mesh may be substantially eliminated despite being in constant contact with the solution. The stainless steel mesh may be further processed (e.g., electropolished) to reduce surface roughness thereby decreasing the mesh's proclivity for residue buildup. All surfaces of the aerosol generation device that may be in direct contact with the atomized solution (e.g., the airway) may also be comprised of electropolished, medical-grade stainless steel to further reduce, or eliminate, any/all required maintenance (e.g., cleaning) that may be required.

The solution to be atomized may contain a non-hydrophobic compound (e.g., a non-hydrophobic CBD compound) such that the propensity for residue buildup onto the mesh and airway may be further reduced. The solution may further be devoid of excipients, such as polyethylene glycol (PEG) or polyethylene oxide (PEO), to further minimize residue within the aerosol generation device for substantially maintenance free operation.

An encasement for the aerosol generation device may include aesthetically pleasing components (e.g., a culinary-grade anodized aluminum body) to reduce weight and the likelihood of corrosion while minimizing cost. The encasement may provide ultimate simplicity, for example, through the elimination of external activation controls and may instead monitor activity (e.g., airflow) at the air ingress and/or air egress ports of the aerosol generation device to activate the atomization process and may further construe spacial orientation changes (e.g., via a three-axis accelerometer) to allow the user to change other aspects of operation (e.g., rate of atomization) of the aerosol generation device simply by altering its spacial orientation in a particular manner.

In other embodiments, external controls (e.g., buttons) may be included within the aerosol generation device's encasement to facilitate the user's control of certain operational characteristics (e.g., rate of delivery of atomized solution) that may be delivered by the aerosol generation device. In other embodiments, the encasement may include input/output (I/O) features, such as a power/data port (e.g., USB-C), a wireless power/data port and a visual indicator (e.g., viewing window) so that the user may monitor a volume of solution that may be contained within the aerosol generation device's liquid reservoir.

The aerosol generation device may include a power supply (e.g., one or more rechargeable batteries) that may be completely encapsulated within its encasement. In one embodiment, the battery may be recharged wirelessly (e.g., via magnetic induction) or recharged via wired access (e.g., via USB-C). A visual indication of the charge level of the power supply may be provided within the encasement and may be activated any number of ways (e.g., movement detection via accelerometer, tactile excitation or detected airflow activity within the airway of the aerosol generation device).

The encasement of the aerosol generation device may include a refillable reservoir within which a solution may be stored until needed for atomization. In one embodiment, the refillable reservoir may be fully encapsulated within the encasement and may include a sealed fill port having a hygienically-suitable surface capable of receiving solution from an external source. The sealed fill port may be self-sealing (e.g., via a spring-loaded door covering the fill port) to prevent egress of the solution once stored. In an alternate embodiment, the refillable reservoir and/or other components (e.g., the atomizing component) may be included within a reusable cartridge that may engage the encasement in such a way that the cartridge may be secured into the encasement during operation, yet removable from the encasement for maintenance (e.g., solution refill).

As discussed above, the solution may be kept in direct contact with the mesh at all times, whether the aerosol generation device is activated or not. Further, the mesh may be sandwiched between the reservoir and the airway of the aerosol generation device such that a geometric configuration of the mesh may be used to facilitate the atomization of the solution into the airway of the aerosol generation device when activated and to prevent leaking of the solution into the airway when deactivated.

In one embodiment, for example, apertures may be arranged within the mesh such that a magnitude of surface tension of solution present at each opening of each aperture may be sufficient to prevent the solution from exiting the mesh and leaking into the airway when the aerosol generation device is deactivated (e.g., when the mesh is not vibrating). Conversely, excitation of the mesh (e.g., via vibration) may exert a force sufficiently larger than the surface tension of the solution so as to force portions (e.g., droplets) of the solution into the airway when the aerosol generation device is activated. Further, a geometric dimension (e.g., diameter) of each aperture may determine the size of droplets formed during atomization.

A transducer (e.g., piezoelectric transducer) may be used to excite (e.g., vibrate) the mesh at one or more amplitudes and one or more frequencies sufficient to atomize the solution during activation of the aerosol generation device. In one embodiment, atomized solution produced by the aerosol generation device may be fixed at a volume that may not be selectable by the user. In such an instance, a particular volume of atomized solution that may be ingested by the user may be determined by the duration of the inhalation period utilized by the user. In an alternate embodiment, a volume of atomized solution to be ingested by the user may be selected by the user through modulation of the amplitude and/or frequency of vibration of the mesh (e.g., via a control mechanism configured within the encasement of the aerosol generation device or a spacial orientation measurement device configured to detect spacial orientation changes).

The aerosol generation device may be configured such that at least a portion of the solution and at least a portion of the mesh may be in direct contact at all times no matter the spacial orientation of the aerosol generation device. Accordingly, the aerosol generation device may atomize the solution once activated whether placed into a normal, inverted or sideways orientation.

Turning to FIG. 1, a top perspective view of aerosol generation device 100 is exemplified, which may include unibody 102 that may exhibit a single molded unit that may form both the body of aerosol generation device 100 as well as a housing for its integral components. As per one example, area 104 may form a portion (e.g., leading edge) of unibody 102, but may also include and integral component (e.g., airway egress port 104) that may facilitate the expulsion of atomized solution meant for ingestion by a user of aerosol generation device 100 as discussed in more detail below. It should be noted that airway egress port 104 may be integrated anywhere within unibody 102, such as along trailing edge 110 of unibody 102.

An additional component (e.g., airway ingress port 108) may also be integrated within unibody 102, which may be utilized by aerosol generation device 100 to draw ambient air into the interior portion (not shown) of unibody 102. The ambient air may then be mixed with the atomized solution within an airway (not shown) of aerosol generation device 100 prior to expulsion via airway egress port 104. It should be noted that airway ingress port 108 may be integrated anywhere within unibody 102, such as along a bottom portion of unibody 102.

Visual indicators may further be integrated within unibody 102, such as visual indicator 106. Depending upon the operation of an internal processor (not shown) of aerosol generation device 100, visual indicator 106 may be indicative of a number of operational parameters. As per one example, the individual components of visual indicator 106 (e.g., each individual arrowhead of visual indicator 106) may be individually backlit by a light emitting diode (LED) (not shown) arranged along an underlying printed circuit board (not shown) in proximity to each arrowhead, such that once illuminated, the light projected by each LED may be viewed by the user and construed in a manner that may be indicative of an operational parameter of aerosol generation device 100.

In one embodiment, visual indicator 106 may be indicative of the charge level of a rechargeable battery (not shown) that may be included in an interior of unibody 102. Full charge may, for example, be indicated by the illumination of all arrowheads of visual indicator 106 in a color (e.g., green) that may be indicative of normal operation. Any less than full charge may, for example, be indicated by the number of arrowheads illuminated and may further be indicated by a color of the illumination. Eighty percent charge may, for example, be indicated by the illumination (e.g., green illumination) of 4 out 5 arrowheads, sixty percent charge may, for example, be indicated by the illumination (e.g., amber illumination) of 3 out 5 arrowheads and forty percent charge may, for example, be indicated by the illumination (e.g., red illumination) of 2 out 5 arrowheads and so on.

In addition, the meaning of visual indicator 106 may be determined by the operational state of aerosol generation device 100 as may be determined by firmware/machine code executed by an internal processor (not shown) of aerosol generation device 100. As per one example, aerosol generation device 100 may include an accelerometer (not shown) that may constantly measure the spacial orientation of unibody 102. Upon the measurement of a particular change in spacial orientation (e.g., trailing edge 110 oriented around 45 degrees below airway egress port 104) by the accelerometer (not shown) as detected by the processor (not shown), visual indicator 106 may initially provide a visual indication of an operational state of aerosol generation device 100 and may then power off. As per one example, the battery charge state as discussed above may be temporarily indicated (e.g., for five seconds) after detection of a spacial orientation change and may then power off.

As per another example, upon the measurement of a particular change in spacial orientation (e.g., trailing edge 110 oriented directly above airway egress port 104) by the accelerometer (not shown) as detected by the processor (not shown), visual indicator 106 may provide a visual indication of a selected rate of atomization. Further, a user of aerosol generation device 100 may increase or decrease the selected rate of atomization through successive spacial orientation changes of aerosol generation device 100 and may be updated as to the selected rate of atomization via visual indicator 106.

In one embodiment, for example, a user may incrementally increase the rate of atomization through successive half rotations of aerosol generation device 100 first in a clockwise direction to invert aerosol generation device 100 and next in a counter-clockwise direction to return aerosol generation device 100 to its original position. In an alternate embodiment, for example, a user may incrementally decrease the rate of atomization through successive half rotations of aerosol generation device 100 first in a counter-clockwise direction to invert aerosol generation device 100 and next in a clockwise direction to return aerosol generation device 100 to its original position.

Figure 2:
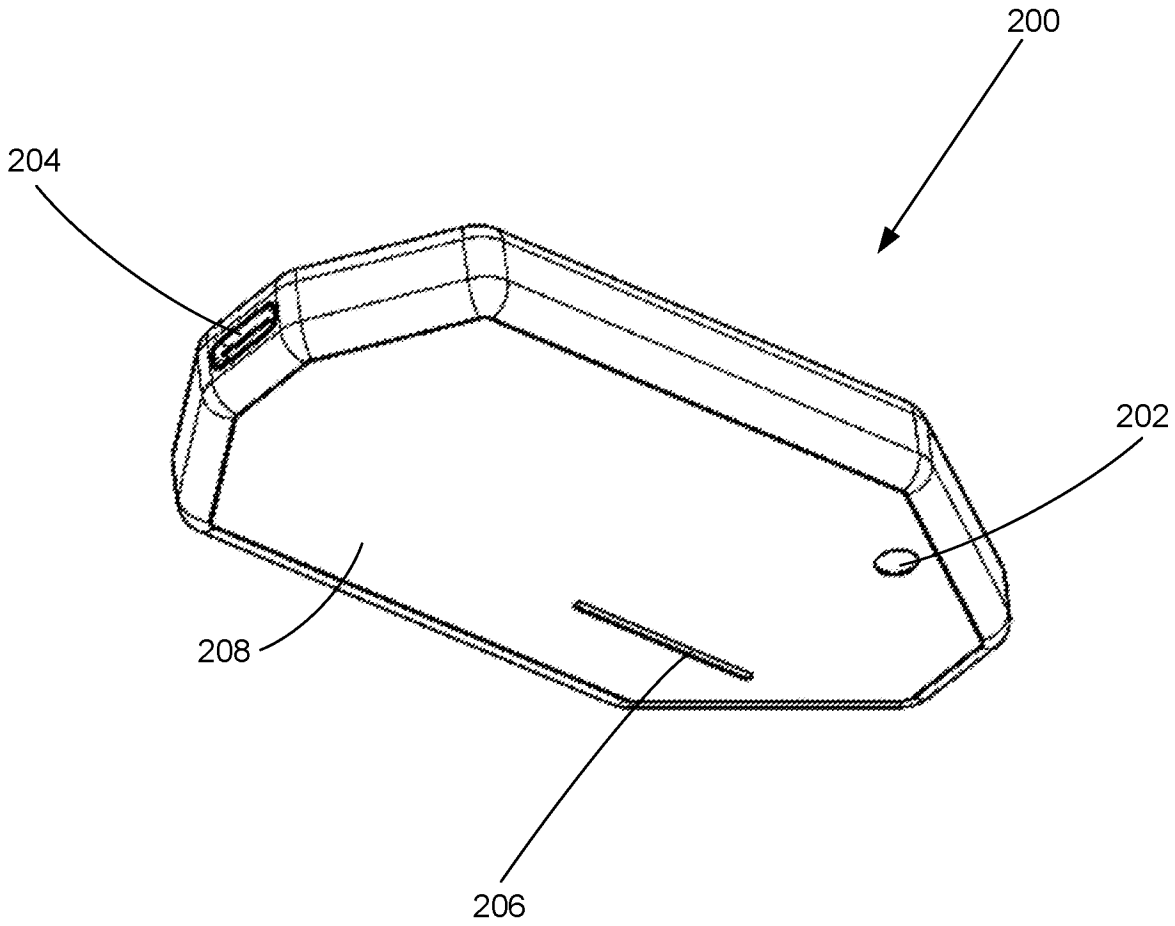
FIG. 2 illustrates a bottom perspective view of an aerosol generation device in accordance with an embodiment of the present invention.

Turning to FIG. 2, a bottom perspective view of aerosol generation device 200 is exemplified, which may include unibody 208 (e.g., as discussed above in relation to unibody 102 of FIG. 1), which may further include additional integrated components. As per one example, aerosol generation device 200 may include an internal reservoir (not shown) that may contain a solution to be atomized by aerosol generation device 200 as discussed in more detail below. Sealable fill door 202 may, for example, be in direct fluid communication with the internal reservoir (not shown). Once opened, sealable fill door 202 may provide a direct fluid communication path between an external container (not shown) and the internal reservoir (not shown), thereby allowing the internal reservoir (not shown) to be refilled. Once refilled, sealable fill door 202 may automatically close (e.g., via spring actuation) to seal the opening to the internal reservoir (not shown).

Viewing window 206 may, for example, be included to allow a user of aerosol generation device 200 to visually determine a volume of solution that may be contained within the internal reservoir (not shown). As per one example, viewing window 206 may be backlit by a light emitting diode (LED) (not shown) arranged along an underlying printed circuit board (not shown) in proximity to viewing window 206, such that once illuminated, the light projected by the LED may allow the user to more easily determine a volume of solution that may be contained within the internal reservoir (not shown). In one embodiment, viewing window 206 may be temporarily backlit (e.g., for five seconds) after the internal processor/accelerometer (not shown) detects a spacial orientation change.

Aerosol generation device 200 may further include a power/data interface (e.g., USB-C 204). The power/data interface may, for example, be used to receive operational power to charge a rechargeable battery (not shown) that may be included within aerosol generation device 200 and may further be used to receive firmway/machine code that may be executed by an internal processor (not shown) within aerosol generation device 200.

Figure 3:
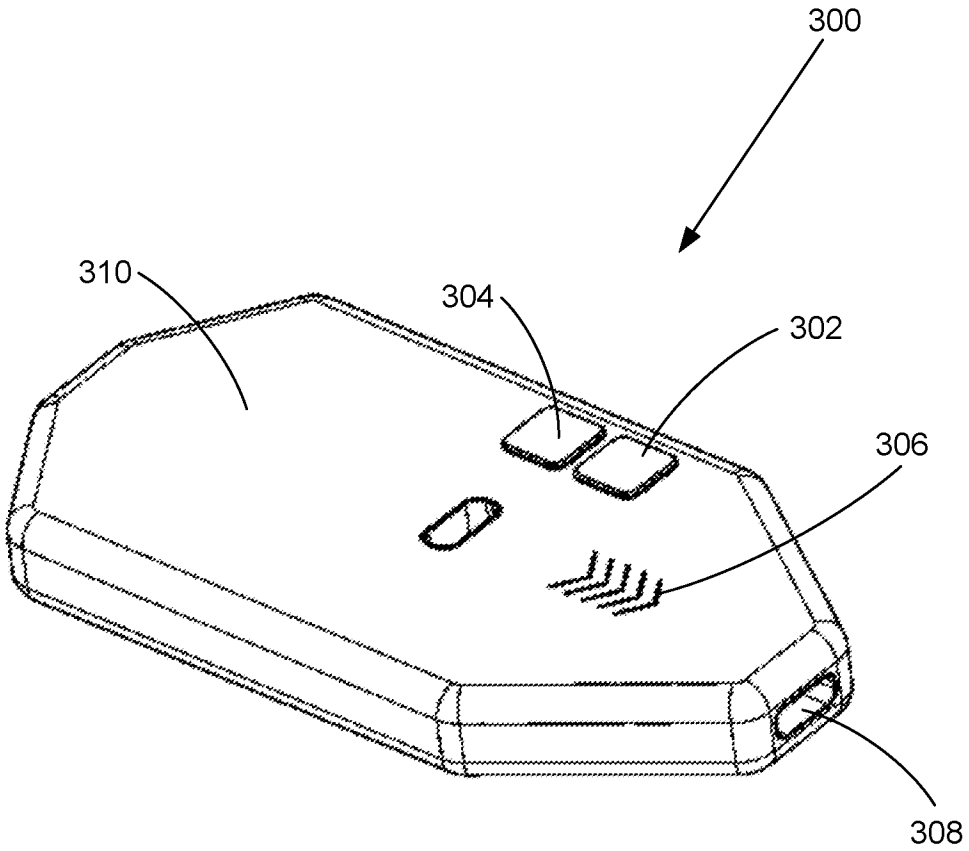
FIG. 3 illustrates a top perspective view of an aerosol generation device in accordance with an alternate embodiment of the present invention.

Turning to FIG. 3, a top perspective view of an alternate embodiment of aerosol generation device 300 is exemplified, which may include unibody 310 (e.g., as discussed above in relation to the unibodies of FIGS. 1 and 2), which may further include additional integrated I/O components (e.g., buttons 302 and 304) that may be used by the user to select operational parameters associated with aerosol generation device 300.

In one embodiment, for example, aerosol generation device 300 may allow the user to select a volume of atomized solution that is to be expelled via air egress port 308 (e.g., as discussed above in relation to airway egress port 104 of FIG. 1). Activation (e.g., via capacitive sense or tactile depression) of button 302 may, for example, cause aerosol generation device 300 to expel an increased volume of atomized solution through actuation of an increased rate of atomization. Conversely, activation (e.g., via capacitive sense or tactile depression) of button 304 may, for example, cause aerosol generation device 300 to expel a decreased volume of atomized solution through actuation of a decreased rate of atomization.

Visual indicator 306 (e.g., as discussed above in relation to visual indicator 106 of FIG. 1) may indicate the user-selected rate of atomization. A maximum atomization rate may, for example, be indicated by the illumination of all arrowheads of visual indicator 306. Any less than a maximum atomization rate may, for example, be indicated by the number of arrowheads illuminated. Eighty percent of maximum atomization rate may, for example, be indicated by the illumination of 4 out 5 arrowheads, sixty percent of maximum atomization rate may, for example, be indicated by the illumination of 3 out 5 arrowheads and forty percent of maximum atomization rate may, for example, be indicated by the illumination of 2 out 5 arrowheads and so on.

Activation of I/O components (e.g., buttons 302 and 304) may cause varied reactions based upon the operational state of aerosol generation device 300. As per one example, simultaneous activation (e.g., capacitive sense or tactile depression) of both buttons 302 and 304 during an idle state of aerosol generation device 300 may cause aerosol generation device 300 to commence solution atomization and a subsequent simultaneous activation (e.g., capacitive sense or tactile depression) of both buttons 302 and 304 during an active state of aerosol generation device 300 may cause aerosol generation device 300 to cease solution atomization. Alternately, activation of either button 302 or 304 during an idle state of aerosol generation device 300 may cause aerosol generation device 300 to report a charge state at visual indicator 306 (e.g., as discussed above in relation to visual indicator 106 of FIG. 1) of the rechargeable battery (not shown) contained within unibody 310 (e.g., as discussed above in relation to the unibodies of FIGS. 1 and 2) of aerosol generation device 300.

Figure 4:
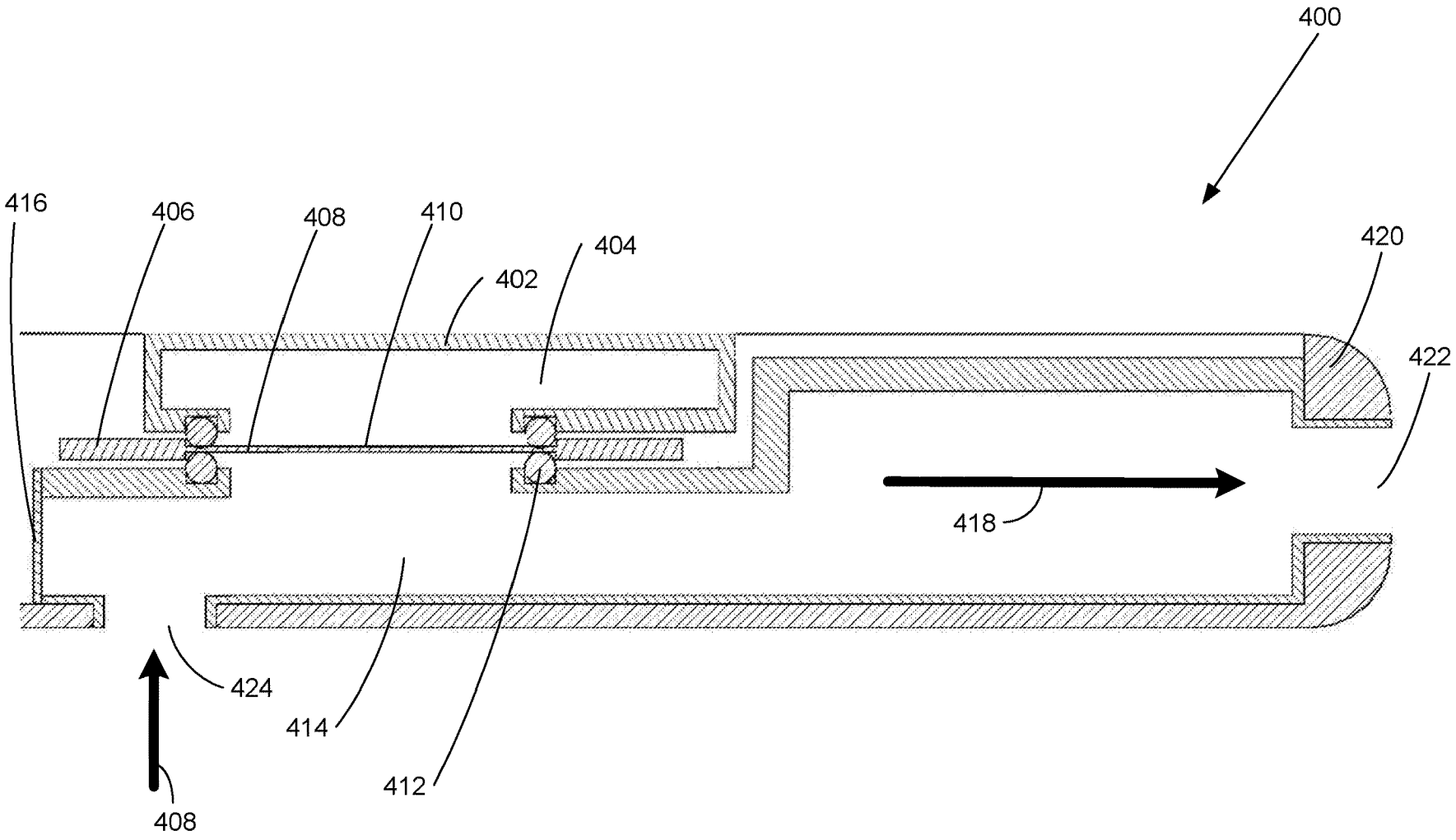
FIG. 4 illustrates a cross-sectional view of an aerosol generation device in accordance with an embodiment of the present invention.

Turning to FIG. 4, a cross-sectional view of aerosol generation device 400 is exemplified. Aerosol generation device 400 may include unibody 420 (e.g., as discussed above in relation to the unibodies of FIGS. 1, 2 and 3) and components 422 and 424 (e.g., as discussed above in relation to the airway egress and airway ingress ports of FIGS. 1 and 3) integrated within unibody 420. Aerosol generation device 400 may further include reservoir 402 and solution 404 contained within reservoir 402 both of which may be fully integrated within unibody 420. It should be noted that while solution 404 may be in direct contact with mesh 410 as shown, non-atomized solution 404 may neverthess be prevented from leaking into airway 414 due to the configuration of mesh 410 as discussed in more detail below. It should be further noted that sealing devices (e.g., hygienic gaskets 412) may restrict solution 404 from access to transducer 406, thereby constraining solution 404 to direct contact with mesh 410 and annular ring 408 only.

In operation, the lips of a user may engage aerosol generation device 400 at airway egress port 422 and the user may then begin inhaling through the user's mouth. In response, ambient air 408 may be caused to enter aerosol generation device 400 at airway ingress port 424, continue as airflow 418 through airway 414, exit aerosol generation device 400 at airway egress port 422 and then traverse the user's bronchial system. In response to airflow 418 being created by the user, airflow 418 may create a slight low pressure system within airway 414, which may then cause pressure sensor 416 to slightly deflect toward airway 414. A processor (not shown) may detect airflow 418 (e.g., through a detection of the deflection of pressure sensor 416) and in response, may then cause atomization of solution 404 into airway 414 (e.g., via vibration of mesh 410) as discussed in more detail below.

In one embodiment, for example, a processor (not shown) may be in electrical communication with a transducer (e.g., piezoelectric transducer 406) and may cause an electrical drive signal to be transmitted to piezoelectric transducer 406 in response to the detection of airflow 418. Piezoelectric transducer 406 may then be caused to deflect rapidly (e.g., vibrate) which may then cause tiny droplets of solution (not shown) to appear within airway 414, which may then be swept into the user's bronchial system when mixed with airflow 418 during the user's inhalation period. It should be noted that pressure sensor 416 may be positioned as shown within aerosol generation device 400 so that pressure sensor 416 may avoid contact with atomized solution that may be contained within airway 414.

Figure 5:
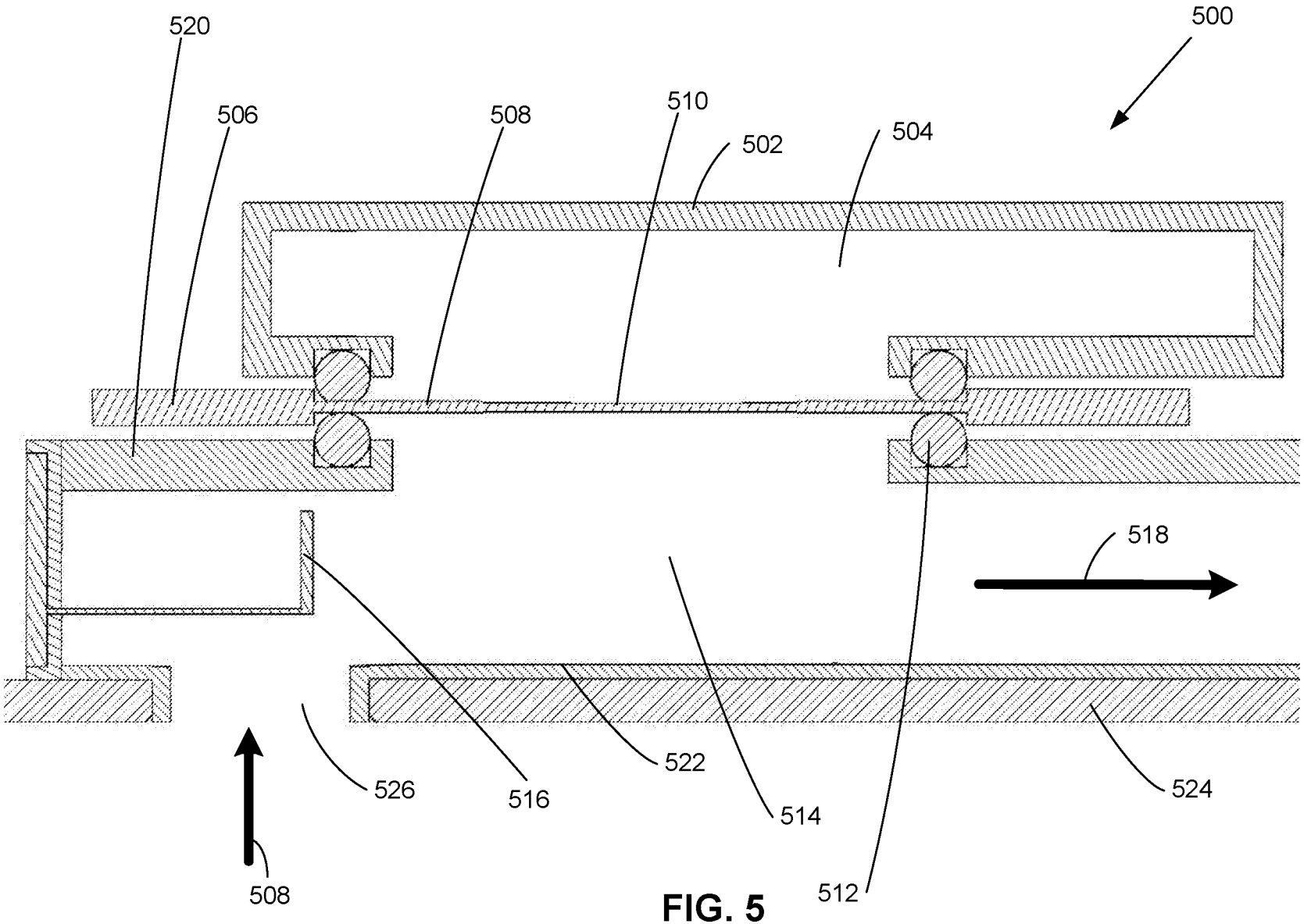
FIG. 5 illustrates a cross-sectional view of an aerosol generation device in accordance with an alternate embodiment of the present invention.

Turning to FIG. 5, a cross-sectional view of an alternate aerosol generation device 500 is exemplified. Aerosol generation device 500 may include unibody 524 (e.g., as discussed above in relation to the unibodies of FIGS. 1, 2 and 3) and component 526 (e.g., an airway ingress port as discussed above in relation to FIGS. 1 and 3) integrated within unibody 524. Aerosol generation device 500 may further include reservoir 502 and solution 504 contained within reservoir 502 both of which may be fully encapsulated within unibody 524. It should be noted that while solution 504 may be in direct contact with mesh 510 as shown, non-atomized solution 504 may neverthess be prevented from leaking into airway 514 due to the configuration of mesh 510 as discussed in more detail below. It should be further noted that sealing devices (e.g., hygienic gaskets 512) may restrict solution 504 from access to transducer 506, thereby constraining solution 504 to direct contact with mesh 510 and annular ring 508 only.

In operation, the lips of a user may engage aerosol generation device 500 at an airway egress port (not shown) and the user may then begin inhaling through the user's mouth. In response, ambient air 508 may be caused to enter aerosol generation device 500 at airway ingress port 526, continue as airflow 518 through airway 514, exit aerosol generation device 500 at an airway egress port (not shown) and then traverse the user's bronchial system. In response to airflow 518 being created by the user, airflow 518 may cause a flap (e.g., conductive flap 516) to rotate within airway 514. As per one example, airflow 518 may cause flap 516 to become electrically communicative with conductive portion 520, thereby effecting a break-before-make connection between flap 516 and conductive portion 520. As per another example, airflow 518 may cause flap 516 to be electrically discommunicative with conductive portion 522, thereby effecting a make-before-break connection between flap 516 and conductive portion 522. A processor (not shown) may detect airflow 518 (e.g., through a detection of the break-before-make and/or the make-before-break connection of flap 516 with conductive portions 520 and/or 522, respectively) and in response, may then cause atomization of solution 504 into airway 514 (e.g., via vibration of mesh 510) as discussed in more detail below.

In one embodiment, for example, a processor (not shown) may be in electrical communication with a transducer (e.g., piezoelectric transducer 506) and may cause an electrical drive signal to be transmitted to piezoelectric transducer 506 in response to the detection of airflow 518. Piezoelectric transducer 506 may then be caused to deflect rapidly (e.g., vibrate) which may then cause tiny droplets of solution (not shown) to appear within airway 514, which may then be swept into the user's bronchial system when mixed with airflow 518 during the user's inhalation period. It should be noted that flap 516 may be positioned as shown within aerosol generation device 500 so that flap 516 may avoid contact with atomized solution that may be contained within airway 514.

Figure 6B:
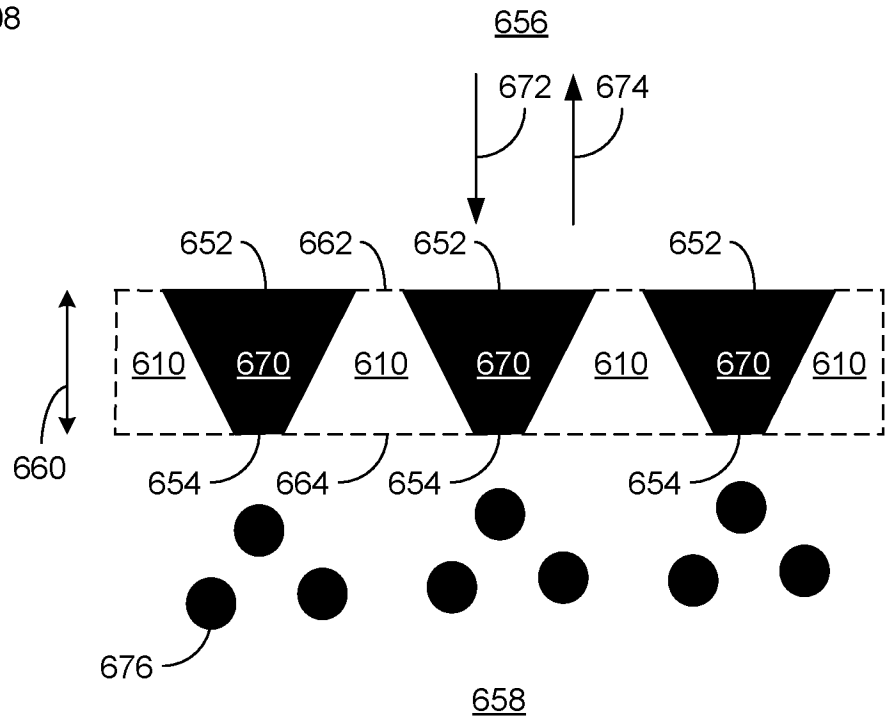
FIGS. 6A and 6B illustrate a mesh assembly in accordance with an embodiment of the present invention.
Figure 6A:
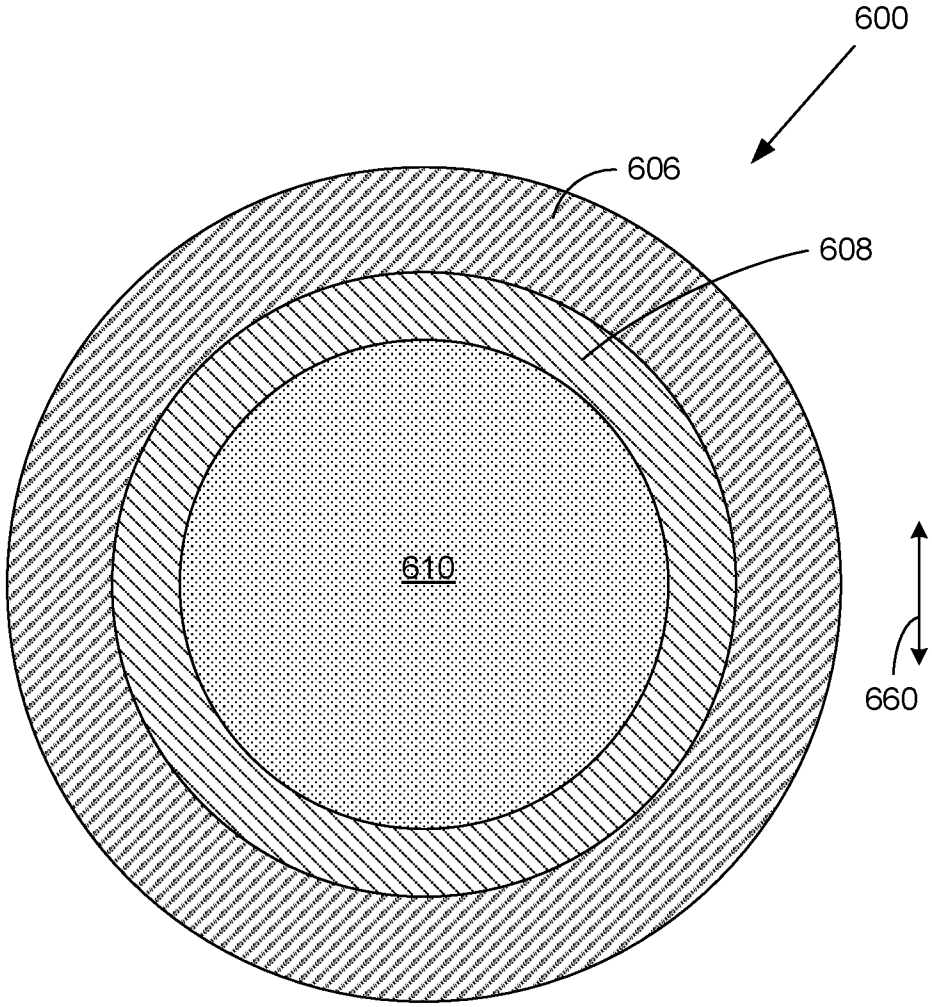

Turning to FIG. 6A, a top view of mesh assembly 600 is exemplified, which may include transducer portion 606 (e.g., as discussed above in relation to transducer 406 and 506 of FIGS. 4 and 5, respectively), ring portion 608 (e.g., as discussed above in relation to annular ring 408 and 508 of FIGS. 4 and 5, respectively) and mesh portion 610 (e.g., as discussed above in relation to mesh 410 and 510 of FIGS. 4 and 5, respectively). Top and bottom portions of transducer portion 606 may include electrical leads (not shown) so that an electrical stimulus may be applied to cause transducer portion 606 to deflect rapidly (e.g., vibrate). As transducer portion 606 vibrates, vibrations may also be imparted to mesh portion 610 via ring portion 608.

Turning to FIG. 6B, a cross-sectional view of mesh portion 610 is exemplified, which may include apertures 652 and 654. In one embodiment, apertures 652 may exhibit a larger diameter as compared to the diameter of apertures 654. In an alternate embodiment, the diameter of apertures 652 and 654 may be substantially equal. Portions 610 may, for example, be comprised of a medical-grade stainless steel and portions 670 may represent voids within mesh 610, such voids 670 being created by an etching process (e.g., laser-etching process).

A dimension (e.g., depth 660) may represent a height of mesh portion 610, whereby voids 670 may be formed as geometrically shaped (e.g., conically shaped) channels extending from top portion 652 to bottom portion 654 of channels 670. Mesh assembly 600 may be sandwiched between a volume of solution (not shown) that may occupy space 656 (e.g., reservoirs 402 and 502 as discussed above in relation to FIGS. 4 and 5, respectively) and space 658 (e.g., airway 414 and 514 as discussed above in relation to FIGS. 4 and 5, respectively).

In operation, channels 670 may be filled with solution (e.g., as shown in black), but due to the surface tension of the solution at apertures 654, no solution may drop into space 658 while transducer portion 606 is not vibrating. Once transducer portion 606 begins to vibrate, cyclical force vectors 672 and 674 may be created to pump solution from space 656 into channels 670 via apertures 652 and then through apertures 654 to ultimately produce droplets 676 within space 658.

During a phase of vibration (e.g., as indicated by force vector 674), for example, droplets 676 may be "pinched" off of apertures 654 from a volume of solution occupying channels 670. During a phase of vibration (e.g., as indicated by force vector 672), on the other hand, solution present within channels 670 may adhere to the sidewalls of mesh 610 and apertures 654 (e.g., through capillary action and surface tension) and no droplets 676 may be produced during this phase.

A rate at which the magnitude of cyclical force vectors 672 and 674 may be modulated may determine a number of droplets 676 that may be formed within space 658 over a given time period. Furthermore, a dimension (e.g., diameter) of droplets 676 pinched off from apertures 654 may be selected by appropriate selection of a dimension (e.g., diameter) of apertures 654. As per one example, a diameter of apertures 654 may be selected between about 0.01 μm and about 10 μm (e.g., approximately 4 μm) thereby producing droplets 676 having a diameter between about 0.01 μm and about 10 μm (e.g., approximately 4 μm). Accordingly, a size of droplets 676 may be selected for optimum deposition within the user's bronchial system.

Figure 7:
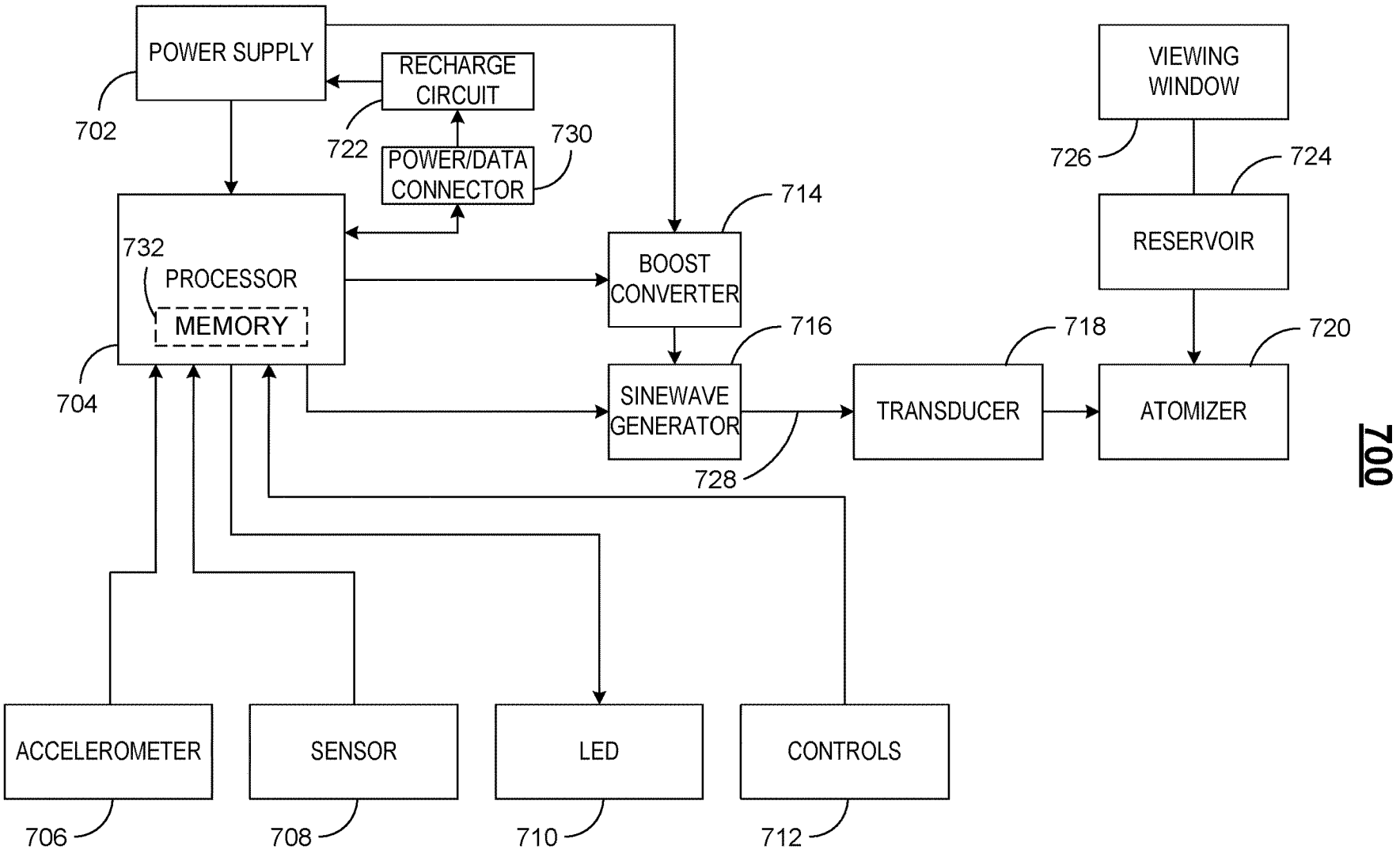
FIG. 7 illustrates a block diagram of an aerosol generation device in accordance with an embodiment of the present invention.

Turning to FIG. 7, a block diagram of aerosol generation device 700 is exemplified, which may include power supply 702, processor 704, various I/O devices 706-712, boost converter 714, sinewave generator 716, transducer 718, atomizer 720, reservoir 724, viewing window 726, recharge circuit 722 and power/data connector 730. Processor 704 may execute firmware/machine code received from power/data connector 730 (e.g., as discussed above in relation to power/data connector 204 of FIG. 2) so as to control the operational states of aerosol generation device 700 as exemplified below. In addition, processor 704 may capture historical data as to the operation of aerosol generation device 700 over time. For example, the user's historical selection of atomized volume control, the user's operational history (e.g., number of hits per day and average length of a user's hit) and the number of refill operations in a given time period may be stored within a memory (e.g., memory 732) of processor 704 and uploaded into a computer (not shown) via power/data connector 730 for future reference.

In one embodiment, power supply 702 may include one or more rechargeable batteries that may be included within a unibody (e.g., as discussed above in relation to the unibodies of FIGS. 1-5). Recharge circuit 722 may accept any of a direct current (DC) signal, alternating current (AC) signal or magnetic signal and convert such signal as appropriate to recharge power supply 702 to achieve adequate operational power levels (i.e., voltage and current) in order to operate aerosol generation device 700 for a period of time (e.g., several days).

Processor 704 may both receive operational power from power supply 702 and may monitor such operational power to determine whether the operational characteristics (e.g., DC voltage magnitude and/or current capacity) of the operational power signal are adequate for operation. Results of such monitoring may be visually indicated (e.g., as discussed above in relation to the visual indicators of FIGS. 1 and 3).

In operation, accelerometer 706 may measure a spacial orientation (e.g., along each of three axes) of aerosol generation device 700 and may report such measurements to processor 704. In response, processor 704 may initiate an operational sequence and/or operational state depending upon the current operational state of aerosol generation device 700.

As per one example, a particular change in spacial orientation may wake processor 704 from a sleep state, in which case processor may then report operational characteristics (e.g., reservoir 724 fill level, power supply 702 charge level) to a user of aerosol generation device 700. In one embodiment, a fill level of reservoir 724 may be visually confirmed with viewing window 726 (e.g., as discussed above in relation to viewing window 206 of FIG. 2) as may be enhanced through illumination of one or more LEDs 710 that may be placed in proximity to viewing window 726 (e.g., via a PCB, not shown, placed in proximity to viewing window 726).

As per another example, a particular change in spacial orientation may wake processor 704 from an idle state, which may then cause processor 704 to monitor sensor 708. In one embodiment, sensor 708 may include a pressure sensor (e.g., as discussed above in relation to pressure sensor 416 of FIG. 4) the activation of which may be indicative of an airflow (e.g., as discussed above in relation to airflow 418 of FIG. 4). In response, processor 704 may begin atomization of the solution contained within reservoir 724 by transducer 718 and atomizer 720 (e.g., as discussed above in relation to mesh assembly 600 of FIGS. 6A and 6B). In an alternate embodiment, sensor 708 may include an airflow indicator (e.g., as discussed above in relation to flap 516 of FIG. 5) the activation of which may be indicative of an airflow (e.g., as discussed above in relation to airflow 518 of FIG. 5). In response, processor 704 may begin atomization of the solution contained within reservoir 724 by transducer 718 and atomizer 720 (e.g., as discussed above in relation to mesh assembly 600 of FIGS. 6A and 6B).

As per other examples, accelerometer 706 may be omitted from aerosol generation device 700 altogether. In such instances, processor 704 may instead monitor controls 712 (e.g., as discussed above in relation to buttons 302 and 304 of FIG. 3) to determine a commanded operation from any of a sleep or idle state as discussed above or to determine a commanded operation in relation to an operational state of aerosol generation device 700. For example, controls 712 may be used by the user to select an adjustable volume of solution to be atomized and/or select a rate of atomization. In yet other examples, controls 712 may be omitted from aerosol generation device 700 altogether and accelerometer 706 may instead be used to select an adjustable volume of solution to be atomized and/or select a rate of atomization as discussed in more detail below.

In one embodiment, for example, boost converter 714 and sinewave generator 716 may combine to generate a sinewave signal (e.g., signal 728 of FIG. 7) having an amplitude between approximately 20V peak-to-peak (P-P) and approximately 90 V P-P (e.g., about 70 V P-P) and a variable frequency sufficient to adequately excite transducer 718 across a frequency band (e.g., between about 15 KHz and 150 KHz) that may include multiple resonance frequencies that may be inherent to the operation of transducer 718. The frequency of sinewave signal 728 may be varied by processor 704 in response to user input at controls 712 (e.g., as discussed above in relation to buttons 302 and 304 of FIG. 3) or in response to spacial orientation change data (e.g., as may be generated by accelerometer 706 when the orientation of aerosol generation device 700 is changed in such a manner as to signal a request from the user to change the frequency of sinewave signal 728).

In one embodiment, for example, activation of button 302 may cause the frequency of sinewave signal 728 to change (e.g., increase) and activation of button 304 may cause the frequency of sinewave signal 728 to change (e.g., decrease). In an alternate embodiment, for example, rotation of aerosol generation device 700 in a clockwise direction may cause the frequency of sinewave signal 728 to change (e.g., increase) and rotation of aerosol generation device 700 in a counter-clockwise direction may cause the frequency of sinewave signal 728 to change (e.g., decrease).

Variation of the frequency of sinewave signal 728 may activate one of several resonance frequencies that may be inherent to the operation of transducer 718. As per one example, transducer 718 (e.g., as discussed above in relation to transducer portion 606 of FIG. 6 and transducers 406 and 506 of FIGS. 4 and 5, respectively) may include a piezoelectric vibrator (e.g., a ceramic vibrator) that may be caused to vibrate at at more than one resonance frequency. In addition, as the resonance frequency is increased, so may the volume of atomized solution and/or the rate of atomization as generated by atomizer 720.

Accordingly, a first frequency of sinewave signal 728 may be selected to be the lowest resonance frequency that may be associated with transducer 718 and in response, may cause the lowest rate of atomized solution to be produced by atomizer 720. A second frequency of sinewave signal 728 may be selected to be the second lowest resonance frequency that may be associated with transducer 718 and in response, may cause the second lowest rate of atomized solution to be produced by atomizer 720. A third frequency of sinewave signal 728 may be selected to be the third lowest resonance frequency that may be associated with transducer 718 and in response, may cause the third lowest rate of atomized solution to be produced by atomizer 720 and so on.

Transducer 718 may exhibit multiple (e.g., 5) discrete resonance frequencies stored within memory 732 and by operation of controls 712 and/or accelerometer 706, a user may toggle between each discrete resonance frequency to generate discrete variations in a rate of atomized solution that may be produced by aerosol generation device 700. The user may then be apprised of the selected rate of atomization via appropriate illumination of LEDs 710 by processor 704 (e.g., as discussed above in relation to the visual indicators of FIGS. 1 and 3). In the absence of controls 712 and accelerometer 706, processor 704 may select a resonance frequency (e.g., one of many resonance frequencies as may be stored within memory 732 of processor 704) as a default frequency of operation.

Figure 8:
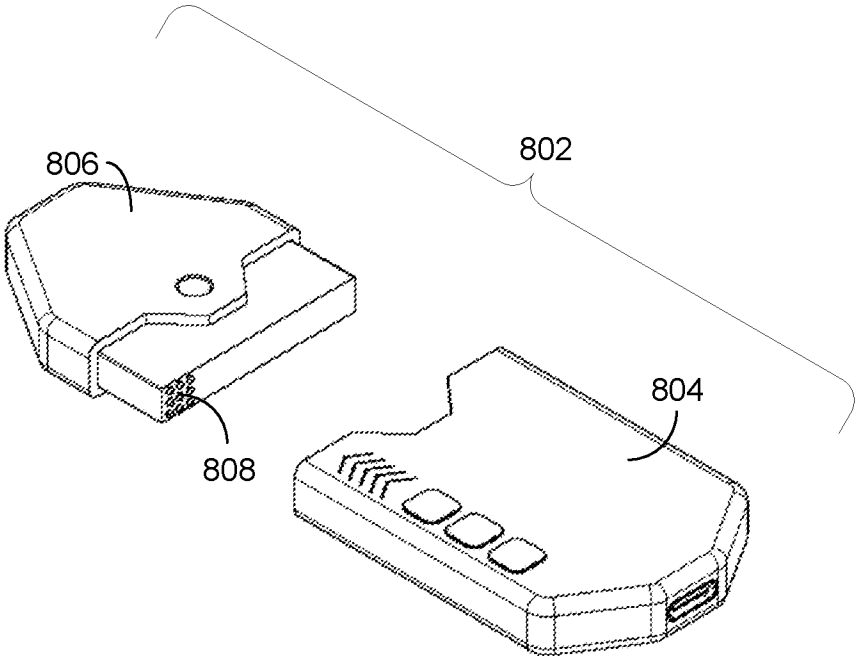
FIG. 8 illustrates an exploded view of an aerosol generation device in accordance with an alternate embodiment of the present invention.

Turning to FIG. 8, an alternate embodiment of aerosol generation device 800 is exemplified, whereby exploded view 802 exemplifies body 804 that may include removable head 806. Head 806 may, for example, may be removably attached to body 804 via a mechanical latching mechanism (e.g., via magnets not shown) that may cause mechanical communication between head 806 and body 804 and may further cause electrical communication between connector 808 of head 806 and a corresponding connector (not shown) of body 804. As such, aerosol generation device 800 may be configured for operation while head 806 may be removably attached to body 804.

In one embodiment, head 806 may be configured with components (e.g., components 708, 718, 720, 724 and 726 as discussed above in relation to FIG. 7) so that various heads 806 may be interchanged with body 804 under certain circumstances. As per one example, a user may possess multiple heads 806 each containing a different solution within a reservoir (e.g., as discussed above in relation to reservoir 724 of FIG. 7) so that the user may change attributes of aerosol generation device 800 (e.g., a flavor of atomized solution, a medicine contained within the atomized solution and/or liquid contained within the reservoir) on demand.

Furthermore, head 806 may be exchanged with replacement heads if/when components (e.g., transducer 718 and atomizer 720 as discussed above in relation to FIG. 7) of head 806 become worn and/or inoperable. In such instances, head 806 may be replaced to accommodate reuse of the electrical components (e.g., processor 704, power supply 702, recharge circuit 722, power/data connector 730, accelerometer 706, LEDs 710, controls 712, boost generator 714 and sinewave generator 716 as discussed above in relation to FIG. 7) of body 804.

Other aspects and embodiments of the present invention will be apparent to those skilled in the art from consideration of the specification and practice of the invention disclosed herein. For example, the aerosol generation device may be implemented with virtually any form factor (e.g., cigarette shaped) so as to facilitate portability. It is intended, therefore, that the specification and illustrated embodiments be considered as examples only, with a true scope and spirit of the invention being indicated by the following claims.

What is claimed is:

1. An aerosol generation device, comprising:

a processor;

an airway egress port;

a user input device coupled to the processor and configured to generate a control signal that is indicative of one of a plurality of frequencies;

a generator configured by the processor to generate a signal having a frequency selected from the plurality of frequencies in response to the control signal from the user input device; and an atomizer in direct contact with a solution, the atomizer configured to provide atomized solution to the airway egress port at a rate proportional to the selected frequency.

2. The aerosol generation device of claim 1, wherein the user input device includes a plurality of buttons.

3. The aerosol generation device of claim 2, wherein the plurality of buttons are configured to generate the control signal in response to sensed capacitance.

4. The aerosol generation device of claim 2, wherein the plurality of buttons are configured to generate the control signal in response to tactile depression.

5. The aerosol generation device of claim 1, wherein the processor is configured to select from the plurality of frequencies stored within a memory of the processor.

6. The aerosol generation device of claim 5, wherein each of the plurality of frequencies correspond to a resonance frequency associated with the atomizer.

7. An aerosol generation device, comprising:

a processor including a memory containing a plurality of resonance frequencies;

an airway egress port;

a generator configured by the processor to generate a signal having a frequency selected by a user from the plurality of resonance frequencies;

an atomizer in direct contact with a solution, the atomizer configured to provide atomized solution to the airway egress port at a rate proportional to the selected frequency; and wherein the processor selects the frequency to be equal to one of the plurality of resonance frequencies associated with the atomizer.

8. The aerosol generation device of claim 7, further comprising a user input device configured to generate a control signal, the control signal being used by the processor to select the frequency.

9. The aerosol generation device of claim 8, wherein the user input device includes a plurality of buttons.

10. The aerosol generation device of claim 9, wherein the plurality of buttons are configured to generate the control signal in response to sensed capacitance.

11. The aerosol generation device of claim 9, wherein the plurality of buttons are configured to generate the control signal in response to tactile depression.

* * * * *